US010787849B1

(12) United States Patent
Guelck

(10) Patent No.: US 10,787,849 B1
(45) Date of Patent: Sep. 29, 2020

(54) SASH BALANCE FOR VERTICAL SLIDER WINDOW

(71) Applicant: PLY GEM INDUSTRIES, INC., Cary, NC (US)

(72) Inventor: Volker Guelck, Calgary (CA)

(73) Assignee: PLY GEM INDUSTRIES, INC., Cary, NC (US)

( * ) Notice: Subject to any disclaimer, the term of this patent is extended or adjusted under 35 U.S.C. 154(b) by 0 days.

(21) Appl. No.: 16/458,382

(22) Filed: Jul. 1, 2019

(51) Int. Cl.
*E05D 13/00* (2006.01)

(52) U.S. Cl.
CPC ..... *E05D 13/1223* (2013.01); *E05D 13/1207* (2013.01); *E05Y 2900/148* (2013.01)

(58) Field of Classification Search
CPC ..... E05D 13/003; E05D 13/04; E05D 13/06; E05D 13/10; E05D 13/12; E05D 13/1207; E05D 13/1223; E05D 13/1276; E05D 13/1292
USPC ..... 16/193, 196, 197, 198, 200
See application file for complete search history.

(56) References Cited

U.S. PATENT DOCUMENTS 3,293,686 A * 12/1966 Lundgren ..... E05D 13/1207 16/197
4,763,447 A * 8/1988 Haltof ..... E05D 13/08 49/429
5,530,991 A * 7/1996 deNormand ..... E05D 13/1207 16/198
5,542,212 A * 8/1996 Erickson ..... E05D 15/22 49/176
6,032,417 A 3/2000 Jakus et al.
6,041,475 A * 3/2000 Nidelkoff ..... E05D 15/22 16/193
6,041,476 A 3/2000 deNormand
6,141,913 A * 11/2000 Wong ..... E05D 15/22 49/183
6,161,657 A * 12/2000 Zhuang ..... B60N 2/23 188/265
6,378,169 B1 4/2002 Batten et al.
D462,258 S 9/2002 Meunier
6,446,391 B1 9/2002 Timothy
D464,256 S 10/2002 Meunier
D467,490 S 12/2002 Uken et al.
6,565,133 B1 5/2003 Timothy
6,598,264 B2 7/2003 Newman
6,679,000 B2 6/2004 Uken et al.
6,745,433 B2 * 6/2004 Newman ..... E05D 13/1207 16/202
6,817,142 B2 11/2004 Marshik
(Continued)

*Primary Examiner* — Jeffrey O'Brien
(74) *Attorney, Agent, or Firm* — Lathrop GPM, LLP

(57) ABSTRACT

A removable balance system for a sash movable vertically between a pair of window jambs. The balance system includes a U-shaped balance channel member and a double block and tackle system disposed within the U-shaped balance channel with a locking feature selectively operable between extending laterally outwardly from the shoe for engagement with an opening in the jamb channel and recessed within the shoe. In operation the locking feature is inserted into an upper most opening in the jamb channel and the cord of the double block and tackle is withdrawn to an extent sufficient for the locking feature to engage a second opening in the jamb channel thereby securing the balance system in place within each jamb providing a seat for the sash atop the two laterally disposed shoes.

21 Claims, 12 Drawing Sheets

(56) References Cited

U.S. PATENT DOCUMENTS 6,820,368 B2 11/2004 Uken et al.
6,877,187 B2 * 4/2005 Newman ..... E05D 13/04 16/193
6,892,494 B2 * 5/2005 Malek ..... E05D 15/22 49/181
6,931,788 B2 * 8/2005 Uken ..... E05D 13/1207 49/181
6,948,279 B1 9/2005 Newton et al.
7,155,778 B2 * 1/2007 Newman ..... E05D 13/04 16/197
7,191,562 B2 3/2007 Uken et al.
7,353,567 B2 4/2008 Newman
7,367,162 B2 * 5/2008 Lucci ..... E05D 13/10 49/445
7,669,284 B2 * 3/2010 Newman ..... E05D 15/22 16/197
7,735,191 B2 6/2010 Tuller
7,735,192 B2 6/2010 deNormand
7,945,994 B2 5/2011 Dallas et al.
7,980,028 B1 * 7/2011 Kunz ..... E05D 13/1276 49/447
8,028,377 B2 * 10/2011 Baker ..... E05D 13/1207 16/197
8,042,227 B2 * 10/2011 Newman ..... E05D 13/1207 16/197
8,074,402 B2 12/2011 Tuller
8,146,204 B2 4/2012 Lucci et al.
8,296,903 B1 10/2012 Steen et al.
8,302,258 B2 11/2012 Lucci et al.
8,424,248 B2 * 4/2013 Uken ..... E05D 15/08 49/506
8,448,296 B2 5/2013 Kellum, III
8,561,260 B2 10/2013 Baker et al.
8,813,310 B2 8/2014 Baker et al.
8,819,896 B2 9/2014 Kellum, III et al.
8,850,745 B2 10/2014 Sofianek et al.
8,966,822 B2 3/2015 Sofianek et al.
9,003,710 B2 4/2015 Kellum, III et al.
9,038,315 B2 5/2015 Kellum, III
9,115,522 B2 * 8/2015 Sofianek ..... E05D 13/12
9,121,209 B2 9/2015 Baker et al.
9,133,656 B2 9/2015 Steen et al.
9,309,709 B2 4/2016 DeNormand et al.
9,458,655 B2 10/2016 deNormand
9,476,242 B2 10/2016 Baker et al.
9,580,950 B2 * 2/2017 Uken ..... E05D 15/22
9,863,176 B2 * 1/2018 Kellum, III ..... E05D 13/12
9,976,329 B1 5/2018 Lucci et al.
D820,077 S 6/2018 Kellum, III
9,988,834 B2 6/2018 Sofianek et al.
9,995,072 B2 6/2018 Baker et al.
10,053,899 B2 8/2018 deNormand et al.
10,472,871 B2 * 11/2019 Kellum, III ..... E05D 13/1207
2005/0193631 A1 * 9/2005 Marshik ..... E05D 15/22 49/183
2011/0302742 A1 * 12/2011 Newman ..... E05D 15/22 16/196
2012/0137587 A1 * 6/2012 Braid ..... E05D 13/04 49/70
2017/0145722 A1 5/2017 Kellum, III
2017/0292303 A1 10/2017 Lucci et al.
2018/0016827 A1 1/2018 Newman
2018/0187466 A1 * 7/2018 Kellum, III ..... E05D 13/12
2018/0291660 A1 10/2018 Kellum et al.

* cited by examiner

SASH BALANCE FOR VERTICAL SLIDER WINDOW

TECHNICAL FIELD

This disclosure is directed to a window balance system and more particularly to a block and tackle balance and shoe assembly for a sliding sash window.

BACKGROUND

A sash window or hung sash window is made of one or more movable panels, or "sashes," that form a frame to hold panes of glass, which are often separated from other panes (or "lights") by glazing bars, also known as muntins. Although any window with this style of glazing is technically a sash, the term is used almost exclusively to refer to windows where the glazed panels are opened by sliding vertically.

Modern window assemblies in residential, commercial and industrial buildings may include one or more window sashes that are movable within a window jamb. Window sashes that move vertically to open and close often include two or more window balance assemblies. The balance assemblies urge the window sash upward (i.e., toward an open position for a lower sash or toward a closed position for an upper sash) to assist a user in moving the window sash and to retain the window sash at a position selected by the user.

SUMMARY

This section provides a general summary of the disclosure, and is not a comprehensive disclosure of its full scope or all its features.

The sash balance system disclosed herein is for a sash movable vertically between a pair of window jambs with vertically extending jamb channels disposed within each of the jambs. The system includes a U-shaped balance channel member with a first end and a second oppositely disposed end as well as a shoe for supporting a lower corner of a sash. The shoe is secured to the second end of the U-shaped balance channel and the shoe further includes an upper portion secured to the U-shaped channel and a lower portion extending perpendicular to the U-shaped balance channel.

The balance system includes a tension spring disposed within the U-shaped balance channel and the tension spring has a first end and a second end such that the first end is secured in position proximate the first end of the U-shaped channel. The sash balance system also includes a translatable pulley assembly with a carrier member disposed within the U-shaped balance channel, carrier member being secured to the second end of the tension spring. A fixed pulley assembly with a carrier member is also disposed within the U-shaped channel proximate the upper portion of the shoe and a roller is disposed within a channel in the upper portion of the shoe.

The sash balance system utilizes a pulley cord with a first end secured to the carrier member of the translatable pulley assembly opposite the connection to the tension spring and the cord also engages the translatable pulley system and the fixed pulley system forming a double tackle configuration and partially encircling the roller before exiting from the shoe. The cord terminates at and is secured to a hook member.

The sash balance also includes a jamb guide secured to the first end of the U-shaped channel that lifts the U-shaped channel a de minimis distance from the jamb channel to limit the drag of friction. The lower portion of the shoe also includes spaced apart first and second walls and an open space between the first and second walls. An activator bar with first and second longitudinally disposed ends is positioned within the open space between the first and second lower portion walls. In addition, the activator bar includes first and second longitudinally separated detent nubs that are disposed on a lower surface of the activator bar. The nubs serving as locations to apply manual pressure on the opposite ends of the activator bar to engage or disengage a locking feature comprising an upwardly facing hook. The activator bar further comprises a laterally extending slot proximate the second end of the activator bar and a longitudinally extending bore, the bore terminating at a back wall proximate the first end of the activator bar.

The sash balance further includes a compression spring with a first end and a second end disposed within the longitudinally extending bore, the first end of the compression spring is disposed against the bore back wall and a restraining pin extends outwardly from the first lower portion wall, through the activator bar slot thereby restraining the second end of the compression spring and finally into the second lower portion wall. The restraining pin maintains the compression spring in a compressed state in the longitudinally extending bore of the activator bar.

The activator bar utilizes a lever arm that extends upwardly and away from the first end of the activator bar terminating at a distal end where a cylinder is transversely mounted. In addition to the activator bar being located within the lower portion, a rocker arm is disposed within the open space between the first and second walls of the lower portion and extends partially into the upper portion of the shoe. The rocker arm is rotatably secured in position by a pin passing through the walls of the upper portion and through a bore hole in the rocker arm. The rocker arm also utilizes an overhanging cutout such that the transverse cylinder of the lever arm slidably engages with the overhanging cutout.

As originally detailed above, extending outwardly from the rocker arm is the locking feature, an upwardly facing hook, that is operable between a first and second position. The first position of the activator bar and rocker arm retracts the locking feature while the second position of the activator bar and rocker arm extends the locking feature.

In operation the locking feature (hook member) is inserted into an upper most opening in the jamb channel and the cord is withdrawn to an extent sufficient for the locking feature to engage a second opening in the jamb channel thereby securing the balance system in place within each jamb providing a seat for the sash atop the two laterally disposed shoes.

An object of the disclosed sash balance is to substantially support the weight of the installed sash.

Another object of the disclosed sash balance is to minimize the complexity of the mechanical functioning of the sash balance and to reduce the cost of production of the sash balance.

Another object of the disclosed sash balance is to facilitate the ease of installation and removal of the sash from the sash balance system.

Another object of the disclosed sash balance is the capability to easily fabricate different sizes of the sash balance to accommodate varying window designs.

The contents of this summary section are provided only as a simplified introduction to the disclosure, and are not intended to be used to limit the scope of the appended claims.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Figure 1:
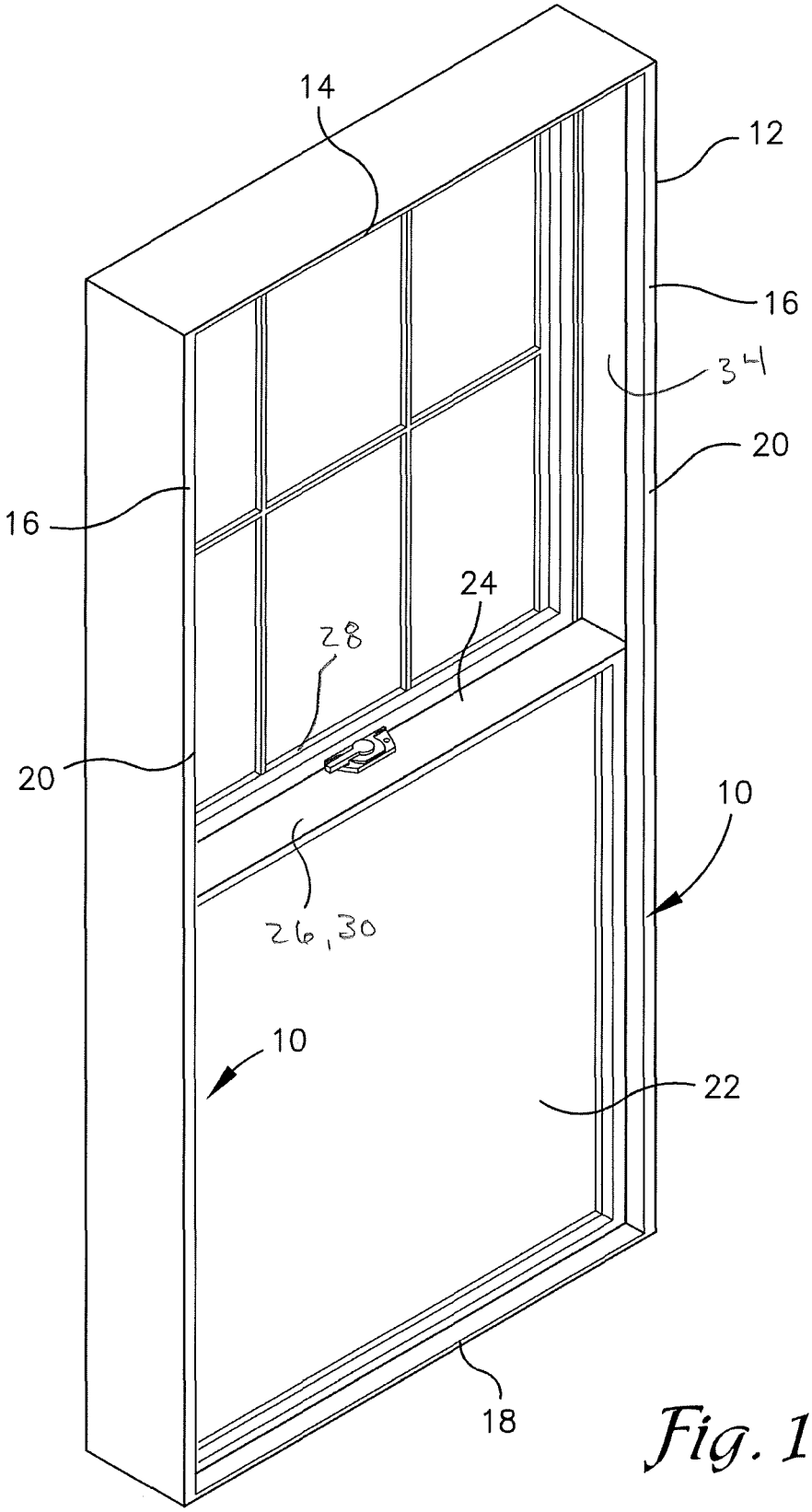
FIG. 1 illustrates a perspective view of a window master frame.

As seen in FIG. 1, disclosed herein is a balance apparatus 10 for mounting in a window frame. FIG. 1 reveals the standard features of a window including the frame 12 which is the framework that surrounds and supports the entire window system, the head 14 which is the main horizontal part forming the top of the window frame, the jambs 16 which are the main vertical parts forming the sides of a window frame, the sill 18 which is the main horizontal part forming the bottom of the frame of a window, the jambliner 20 which is a strip that is mounted to the sides of a window frame that provides a snug fit for the window sash, the balance 10 which is a mechanical device (generally spring loaded) used in single- and double-hung windows as a means of counterbalancing the weight of the sash during opening and closing the sash 22 which is the moveable part of a window made up of the vertical and horizontal frame that holds the glass, the checkrail 24 which is found on a double-hung window, the part where the bottom part of the upper sash and the upper part of the lower sash come into contact, also known as the middle of the window, and the rail 26 the horizontal piece of a window sash—comprised of the lower 28 and upper 30 rail.

A sash balance presently popular is a block and tackle window balance system that include a combination of two or more pulleys, a cord and a spring. The pulleys are grouped as the "block" to reduce the load the homeowner feels when opening and closing a window. In addition, as the cord (or "tackle") is pulled by the movement of the sash it stretches or reduces the tension on the springs, which are weighted to match the sash weight. The pulleys and springs assist with opening and closing the window thereby reducing the effort required by the person opening or closing the window.

Figure 2A:
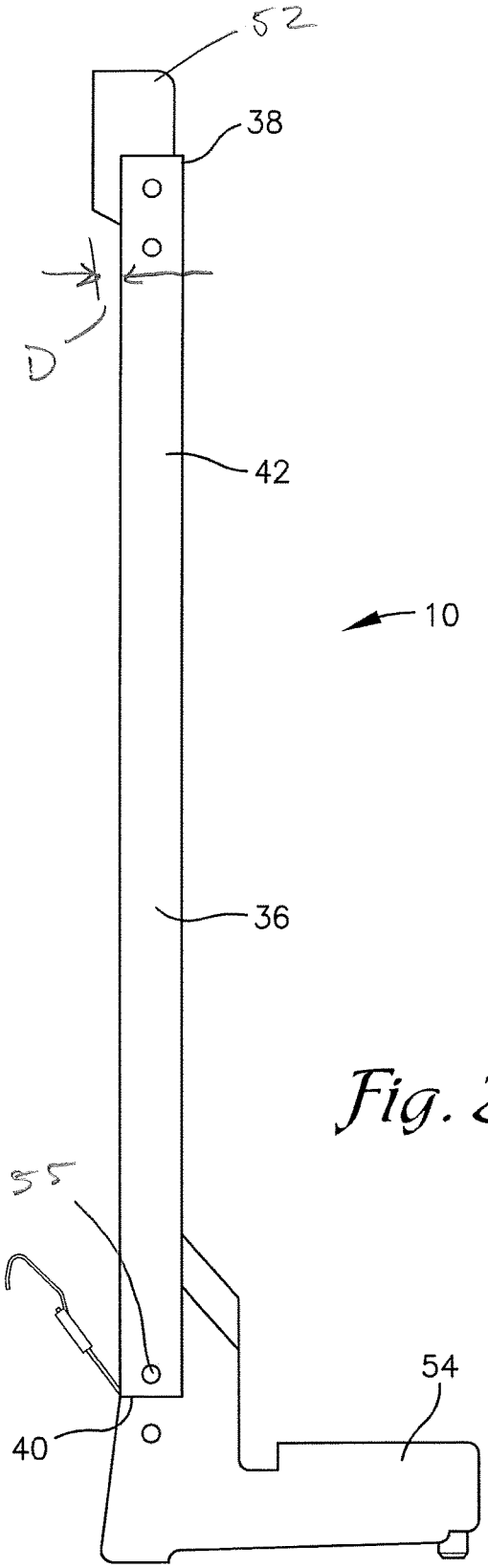
FIG. 2A illustrates a side elevation view of an embodiment of the sash balance disclosed herein.
Figure 2B:
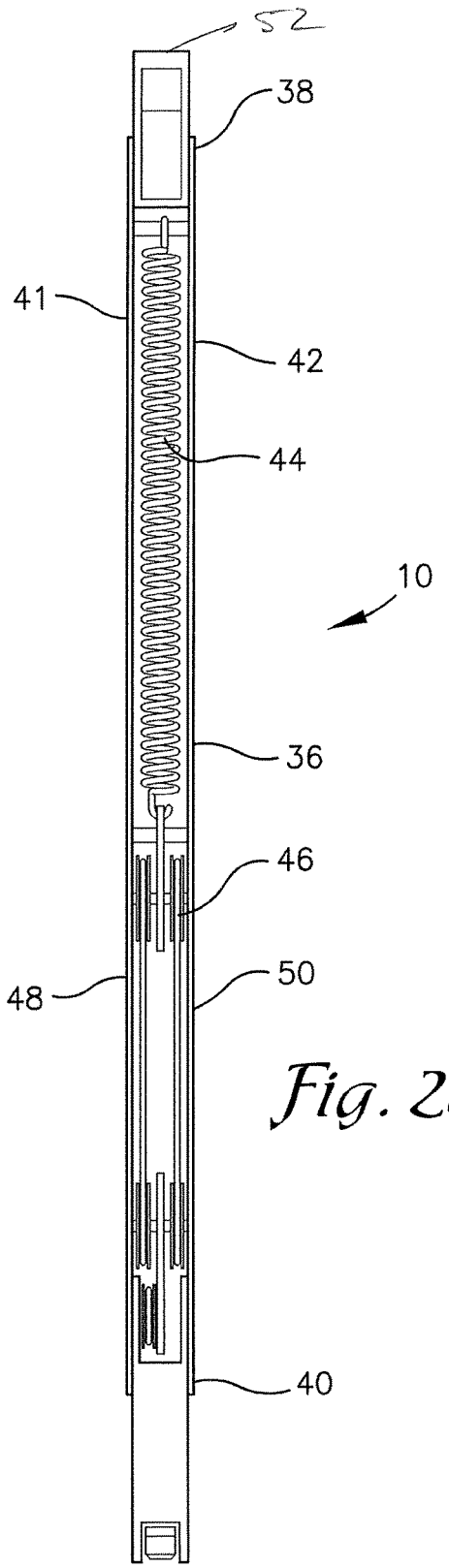
FIG. 2B illustrates a rear elevation view of an embodiment of the sash balance disclosed herein.

The balance apparatus 10 disclosed herein is for a sash 22 movable vertically between a pair of window jambs with vertically extending jamb channels 34 disposed within each of the jambs 16, the specific operation of the balance apparatus 10 will be detailed later in the operational section of this specification. As seen in FIGS. 2A and 2B, the balance apparatus 10 includes a U-shaped balance channel member 36 and has a first end 38 and an oppositely disposed second end 40. The U-shaped channel 36 is preferably fabricated from metal, such as aluminum; however, engineered plastic or even ceramic materials may also be employed. The channel is comprised of two side walls 41, 42 and a bottom 44 and preferably of a consistent thickness. The side walls 41, 42 are of a sufficient height to provide adequate depth to the channel 36 to allow placement of the hardware 46 that will be described in greater detail below without the hardware extending beyond the upper edges 48, 50 of the walls 41, 42.

Figure 3:
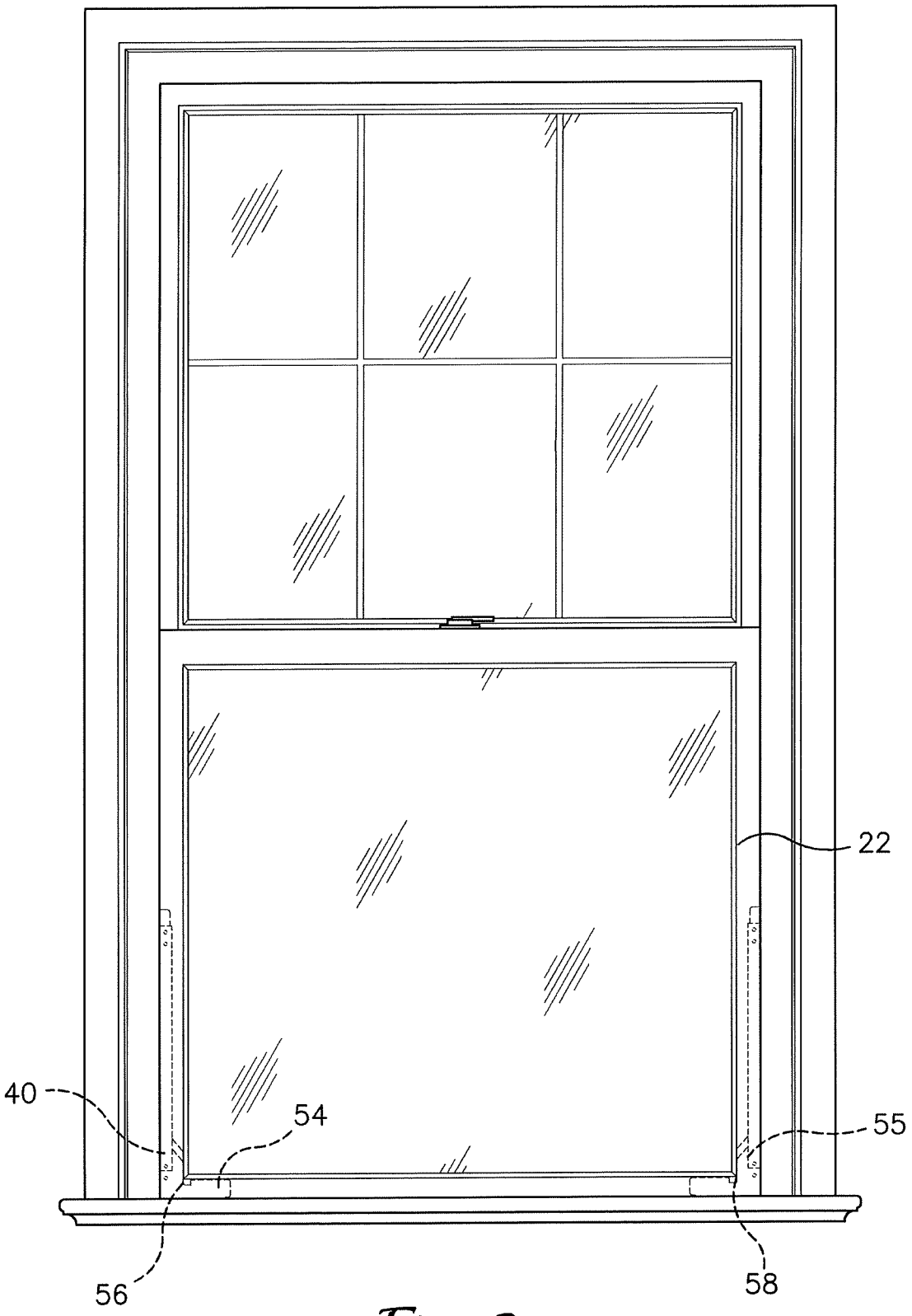
FIG. 3 illustrates a front elevation view of an embodiment of a pair of sash balances shown in phantom supporting a sash in a window frame.

As seen in FIG. 3, the balance apparatus 10 includes a shoe 54 for supporting a lower corner 56, 58 of a sash 22. The shoe 54 is secured to the second end 40 of the U-shaped balance channel 36. The shoe 54 is preferably fabricated from an engineered plastic; however, alternative material options such as metals and ceramics may also be employed. The shoe is also preferably secured to the U-shaped channel with one or more fasteners such as a rivet 55; however, alternative means such as adhesives or sonic welding may also be utilized.

Figure 4:
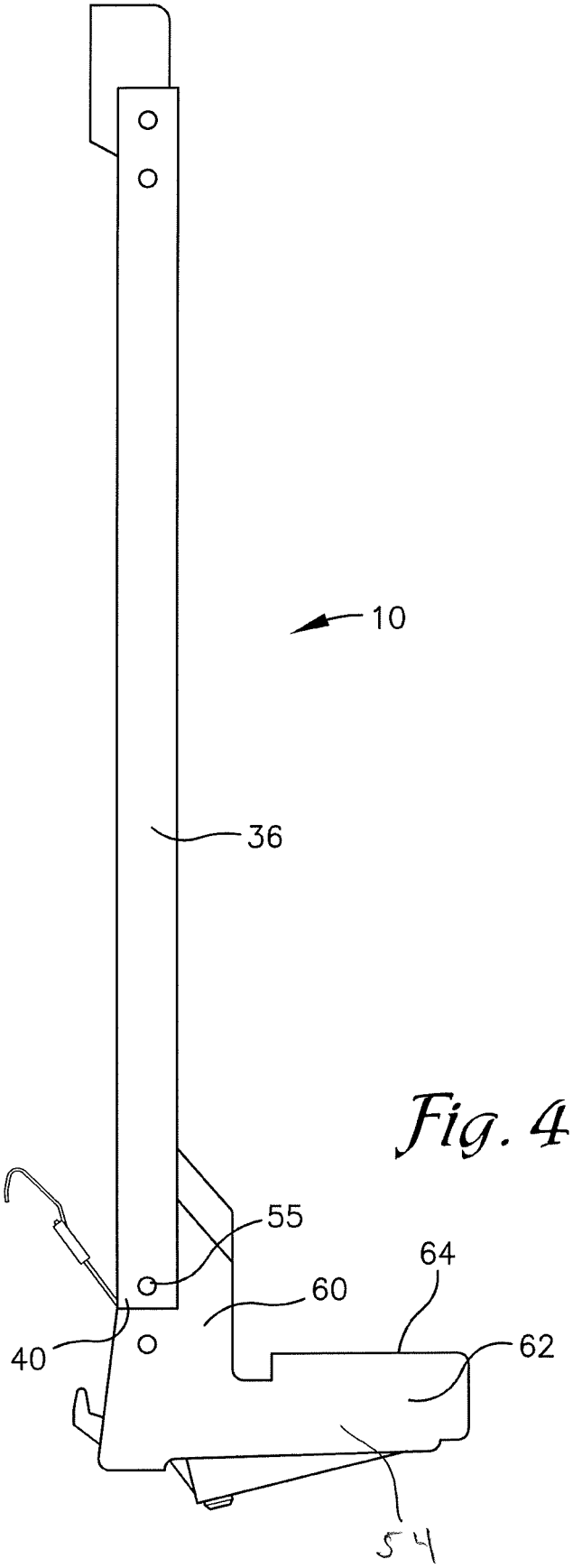
FIG. 4 is a side elevation view of an embodiment of the sash balance disclosed herein.
Figure 5:
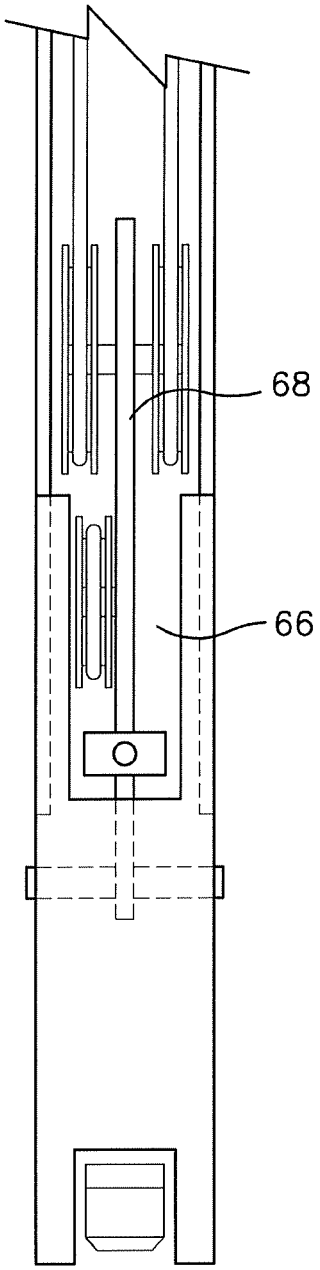
FIG. 5 is a rear elevation view of an embodiment of the fixed pulley assembly of the sash balance as disclosed herein.

The balance shoe 54, as seen in FIG. 4 includes an upper portion 60 which is secured to the second end 40 of the U-shaped channel 36 and a lower portion 62 that is preferably monolithically molded with the upper portion 60. The lower portion 62 extends perpendicular to the U-shaped balance channel 36 and employs a platform 64 that extends toward the center of the sash 22 once the sash balance apparatus 10 is installed onto the jamb channels 34. The upper portion 60 of the shoe 54 is inserted into the second end 40 of the U-shaped balance channel 36 and as seen in FIG. 5 includes a cutout portion 66 for insertion of additional hardware 68 components as is discussed below in greater detail.

Figure 6B:
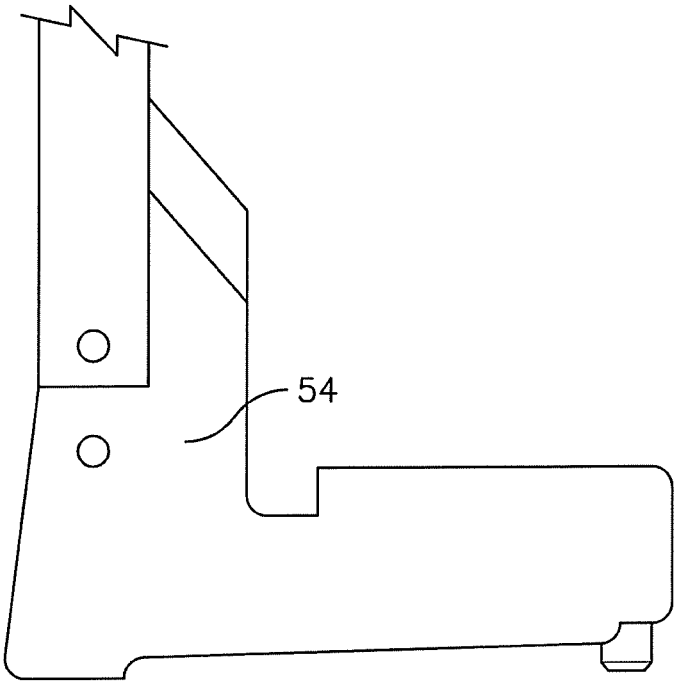
FIG. 6B is a side elevation view of an embodiment of the shoe area of the sash balance disclosed herein with the locking feature fully retracted.
Figure 6A:
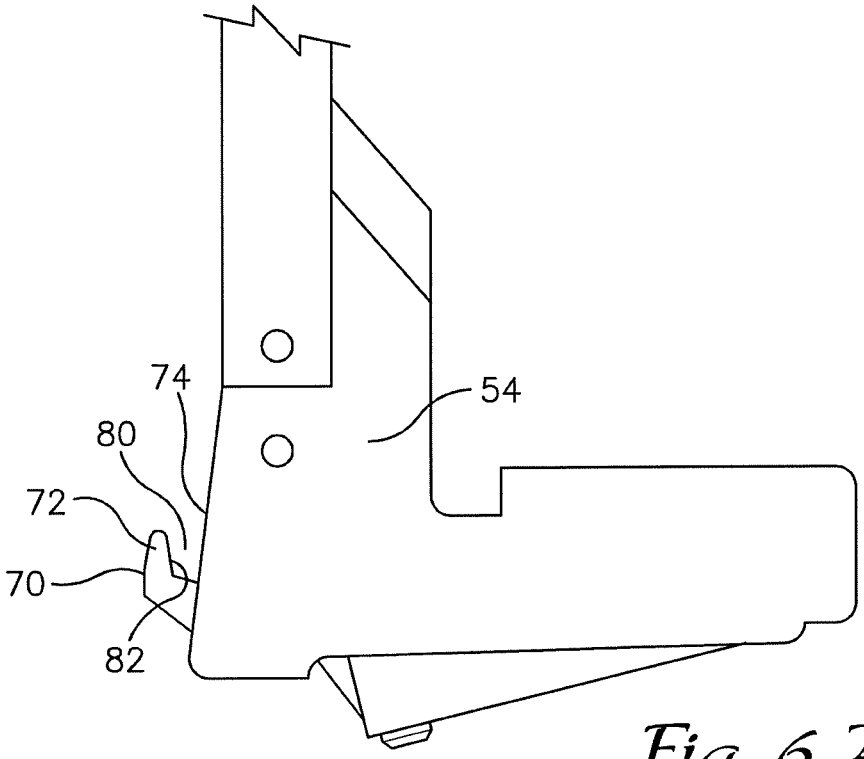
FIG. 6A is a side elevation view of an embodiment of the shoe area of the sash balance disclosed herein with the locking feature fully extended.

The balance shoe 54, as seen in FIG. 6A includes a locking feature 70 in the form of an upwardly facing hook 72 that is selectively operable between: (1) extending laterally outwardly from a rear face 74 of the shoe 54 for engagement with an opening 76 in the jamb channel, and (2) recessed within the shoe 54 as seen in FIG. 6B. The locking feature 70 is configured for securing the shoe 54 against upward movement when installed within the jamb channel 34. The locking feature 70 when extended, as shown in FIG. 6A includes a gap 80 between the backside 82 of the upward facing hook 72 and the rear face 74 of the shoe 54.

Figure 7:
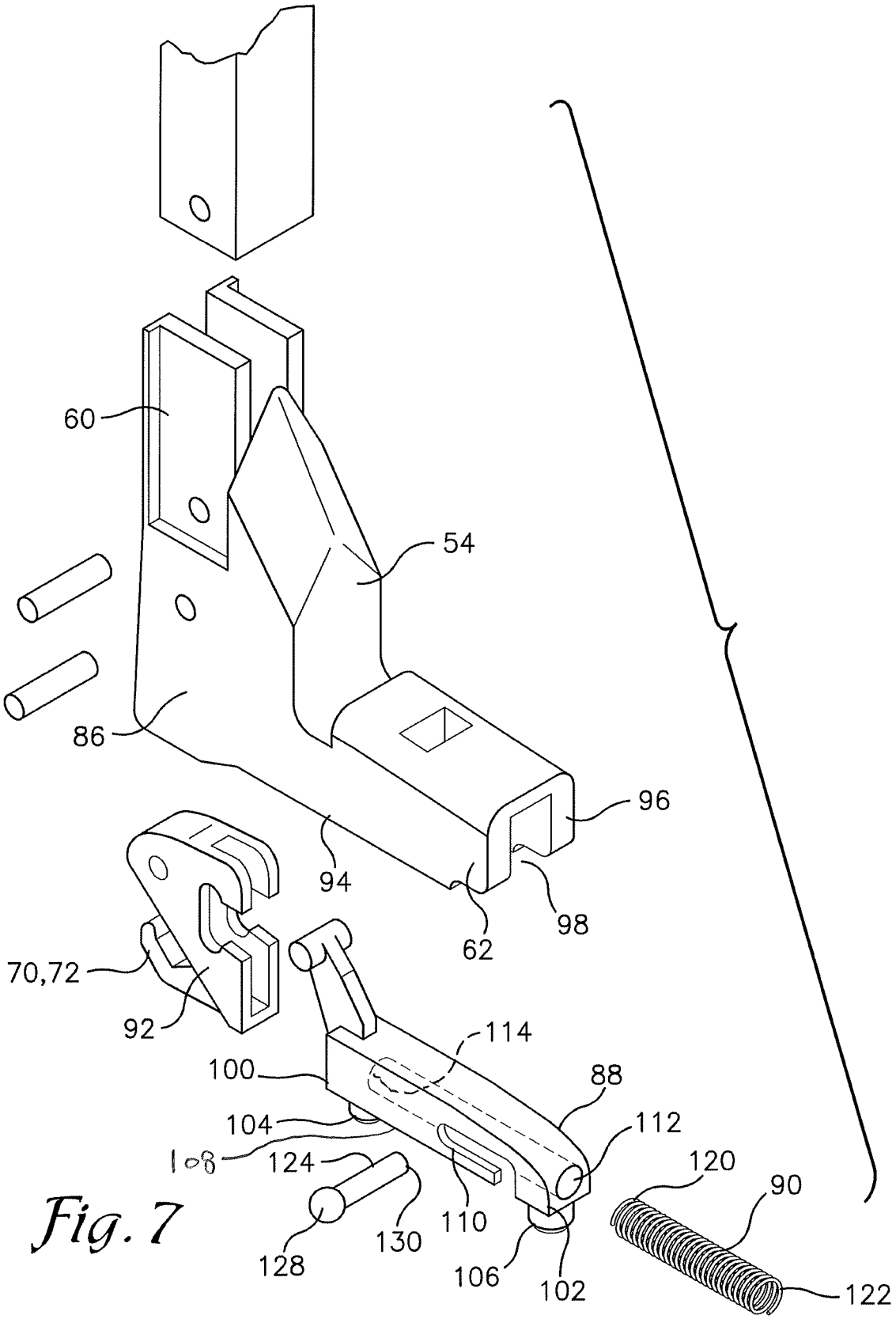
FIG. 7 is an exploded assembly view of embodiments of the shoe housing, rocker arm, activator bar and compression spring as disclosed herein.

As seen in FIG. 7, the shoe 54 in functional form is comprised of four principle separate and interacting components a shoe housing 86, an activator bar 88, a compression spring 90, and a rocker arm 92. These four principle components and additional restraining features that are discussed below in greater detail, are disposed primarily in the lower portion 62 of the shoe 54 and to a lesser extent in the upper portion 60 of the shoe between spaced apart first and second walls 94, 96 in the open space 98 between the first and second walls. The activator bar 88 is disposed within the open space 98 between the first and second lower portion walls 94, 96. The activator bar 88 has first and second longitudinally disposed ends 100, 102 and nubs 104, 106 that extend downwardly from the oppositely disposed ends of lower surface 108 of the activator bar 88. The nubs 104, 106 serve as manually activated pressure points for deployment and retraction of the hook 72 of the locking feature 70. The activator bar 88 also includes a slot 110 extending laterally across the activator bar proximate the second end 102 of the activator bar 88.

FIG. 7 further reveals that the activator bar 88 also includes a longitudinally extending bore 112 that originates at the second end 102 and terminates at a back wall 114 proximate, but not actually penetrating through to the first end 100 of the activator bar. The longitudinally extending bore 112 may be formed via a drilling operation or the activator bar 88 may be molded with each half of the molded activator bar incorporating a semi-circular trough such then when the segments are brought together the two troughs form the bore 112.

Also seen in FIG. 7 is the compression spring 90 with a first end 120 and a second end 122 inserted into the longitudinally extending bore. The first end of the compression spring 120 is disposed against the bore back wall 114. The second end 122 of the compression spring is restrained in position within the bore 112 by a restraining pin 124 that passes through the slot 110. When the activator bar 88 is in position within the lower portion 62 of the housing 86 of the shoe 54 the first and second ends 128, 130 of the restraining pin 124 are secured to the spaced apart walls 94, 96 and spans the open space 98. The spring 90 provides the force needed to securely position the locking feature 70, to include the upward facing hook 72, into either the extended or the retracted positions (FIGS. 6A and 6B) depending upon which nub 104, 106 is depressed.

Figure 8:
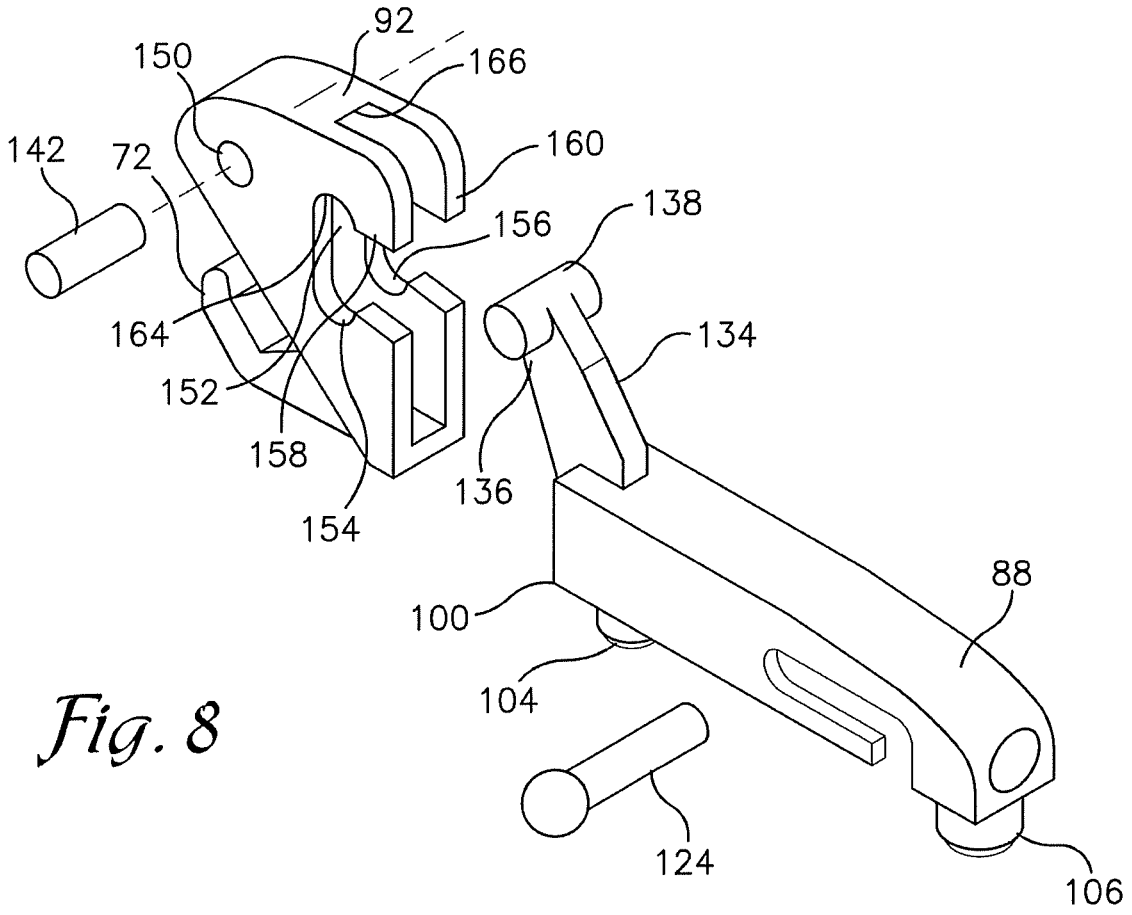
FIG. 8 is a perspective view of embodiments of the rocker arm and activator bar as disclosed herein.

FIG. 8 reveals that the activator bar 88 also utilizes a lever arm 134 that extends upwardly and away from the first end 100 of the activator bar terminating at a distal end 136. A cylinder 138 is transversely mounted to the distal end 136 of the lever arm 134. As previously discussed, the activator bar 88 is disposed within the lower portion 62 of the housing 86 of the shoe 54 and the rocker arm 92 is disposed adjacent the activator bar 88 within the open space 98 between the first and second walls 94, 96 of the lower portion 62 and extends partially into the upper portion 60 of the shoe 54.

Figure 9:
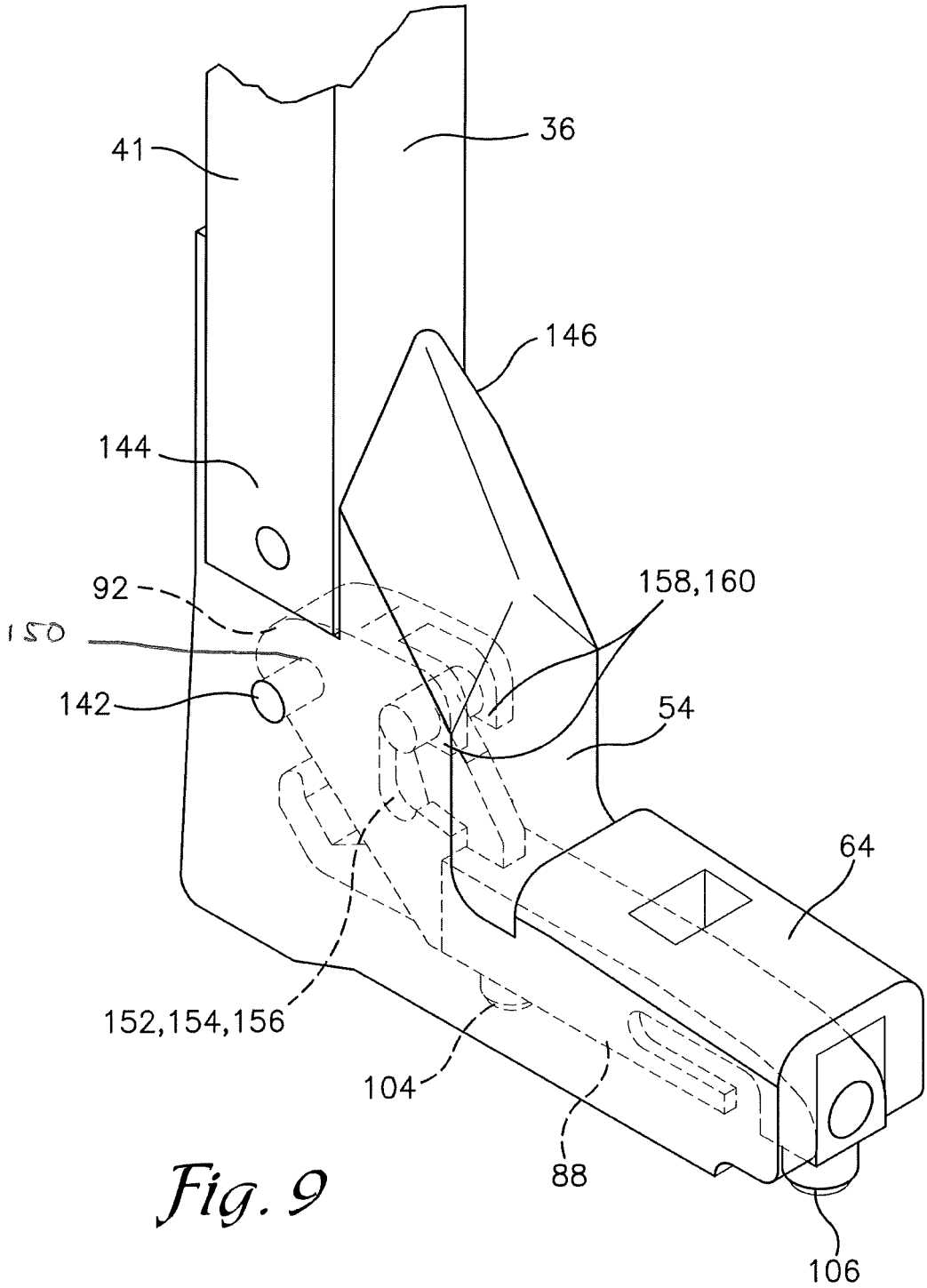
FIG. 9 is a perspective view of the shoe with the activator bar and rocker arm in hidden lines to identify their orientation within the housing.

As seen in FIG. 9, the rocker arm 92 is rotatably secured in position by a pin 142 passing through the walls 144, 146 of the upper portion 60 and through a bore hole 150 in the rocker arm 92. The rocker arm has an overhanging cutout 152 that includes saddles 154, 156 at the bottom of the cutout 152 and downwardly extending fingers 158, 160.

The transversely mounted cylinder 138 atop the lever arm 134 slidably engages with the overhanging cutout 152. The range of motion of the transversely mounted cylinder is limited to the span of the cutout 152. The range of motion of the cylinder 138 and lever arm 134 is limited to the span between the seats 164, 166 at the top of the cutout 152 and saddles 154, 156 at the bottom of the cutout. Moreover, the pin 142 securing the rocker arm 92 in position and the pin 124 securing the activator bar 88 in position prevent the dislocation of the rocker arm 92 and the activator bar 88 from their places of residence within the shoe housing 86.

The compression spring 90 provides the force to drive the lever arm 134 and cylinder 138 into the seats 164, 166 at the top of the cutout 152. When the user manually presses upwardly on the outlying nub 106 this causes the activator bar 88, lever arm 134 and cylinder 138 to rotate downward with the cylinder 138 resting within the saddles 154, 156 at the bottom of the cutout 152. As the cylinder 138 rotates downward within the cutout 152, this causes the rocker arm 92 to rotate about the pin 142 that secures the rocker arm 92 in position. The upwardly facing hook 72 is rotated outwardly from the lower portion 62 of the shoe 54 and is in a position ready for engagement with an opening in the jamb channel and to counter the force applied by the spring and pulley system of the balance system.

When the operator seeks to withdraw the upwardly facing hook 72 into the shoe 54, the downwardly facing nub 104 is manually pressed, in an upward direction, which overcomes the resistance exerted by the compression spring 90 and drives the lever arm 134 and cylinder 138 of the activator bar 82 upward within the cutout 152 and into the seats 164, 166 at the top of the cutout. This upward movement of the lever arm 134 and cylinder 138 causes a rotation of the rocker arm 92 that retracts the hook 72 back into the shoe housing 86 facilitating vertical movement of the balance system 10 with the installed sash.

Figure 10:
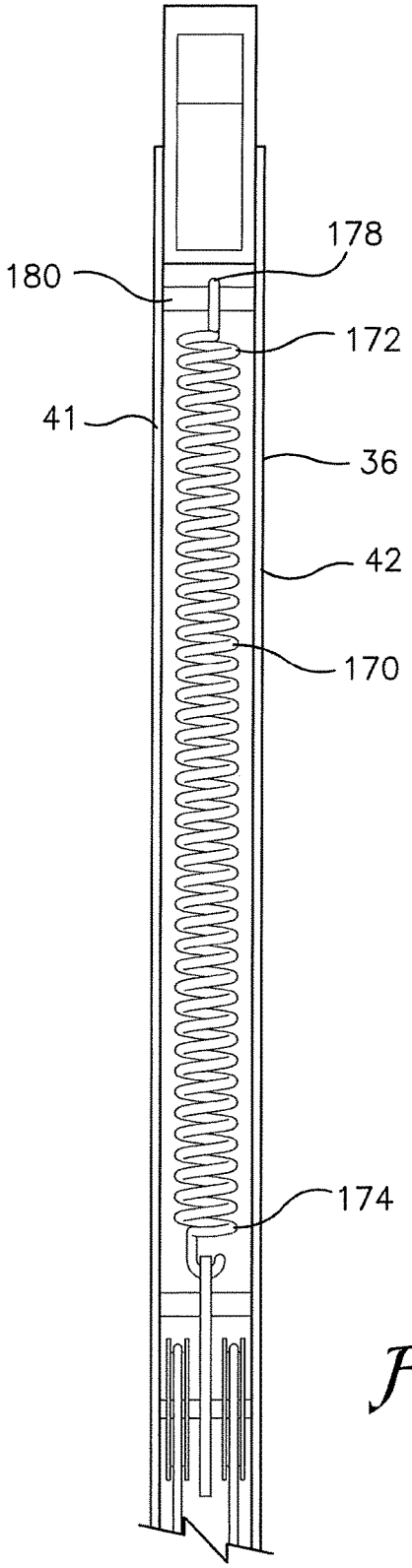
FIG. 10 is an elevation view of a rear portion of the sash balance illustrating an embodiment of the translatable pulley assembly.

As seen in FIG. 10, the sash balance apparatus also utilizes a tension spring 170 disposed within the U-shaped balance channel 36. The tension spring 170 includes a first end 172 and a second end 174 wherein the first end 172 is secured in position proximate to the first end of the U-shaped channel 36 with a hook 178, in a preferred embodiment, secured to a cross bar 180 that spans from the first wall 41 to the second wall 42 of the U-shaped balance channel 36. The free length, body length, wire diameter, loop length and outside diameter of the tension spring 170 are dictated by the specific load characteristics of the sash to be balanced and the travel of the sash between a closed and fully open position.

Figure 11:
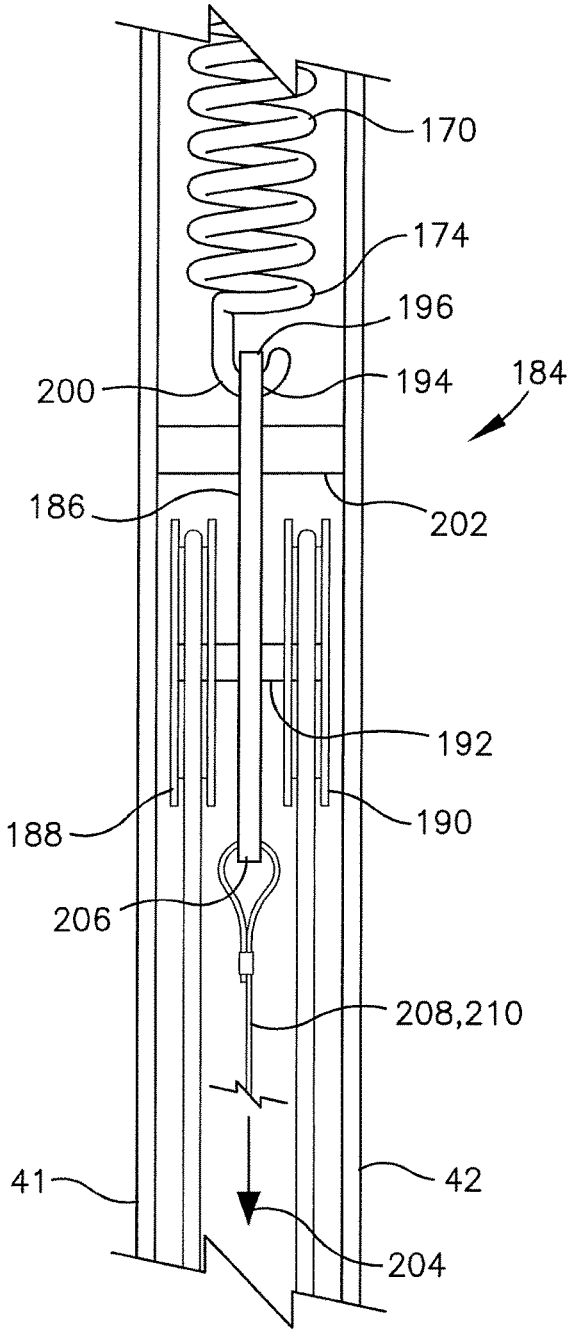
FIG. 11 is an elevation view of a rear portion of the sash balance illustrating an embodiment of the fixed pulley assembly.

FIG. 11 reveals an embodiment of a translatable pulley assembly 184 with a carrier member 186 disposed within the U-shaped balance channel 36. The translatable pulley assembly 184 consists of a pair of pulleys 188, 190 separated by the carrier member 186. An axle 192 passes through the carrier member 186 and the two pulleys 188, 190 are mounted to the axle 192, one on each side of the carrier member 186. The carrier member 186 is preferably a thin metal plate that includes an opening 194 at a first end 196 through which the second end 174 of the tension spring 170 is secured by a second spring hook 200. A translatable pulley guide 202 is also optionally utilized to maintain the pair of pulleys 188, 190 centered within the U-shaped balance channel 36 during translation within the channel.

Figure 12:
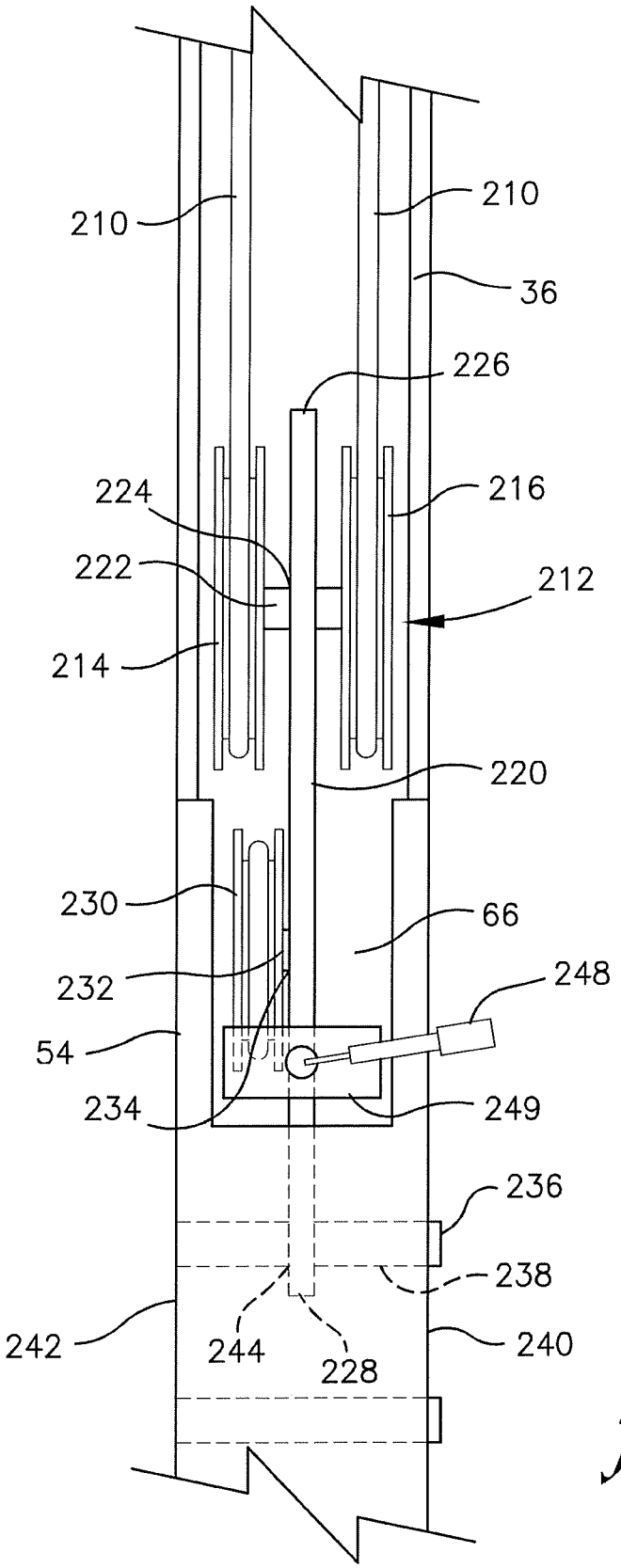
FIG. 12 is an elevation view of a rear portion of the sash balance illustrating an embodiment of the fixed pulley assembly and the pulley cord.

As seen in FIGS. 11 and 12, the counterbalance to the tension spring 170 secured through the opening 194 at the first end 196 of the carrier member 186 is a load 204 applied at the second end 206 of the carrier member 186. The load 204 is maintained with the use of a first end 208 of a pulley cord 210. The pulley cord 210 extends within the U-shaped channel 36, as seen in FIG. 12, to a fixed pulley assembly 212 that is disposed superjacent to the cutout portion 66 of the shoe 54. The fixed pulley assembly 212 is comprised of two pulleys 214, 216, preferably similar in dimension in all respects to the two pulleys 188, 190 of the translatable pulley assembly 184. The two pulleys are separated by a fixed pulley assembly carrier member 220. This carrier member 220 also includes an axle 222 passing through an opening 224 near the first end 226 of the carrier 220

Mounted to the axle 222 on each side of the carrier member 220 are the two pulleys 214, 216. Secured roughly mid-way between the first end 226 and the second end 228 of the carrier member 220 is a single roller 230 riding on an axle 232 that passes through an opening 234 in the carrier member 220. The second end 228 of fixed pulley assembly carrier member 220 is secured to the shoe housing 86. The mechanism of attachment of the carrier member 220 to the shoe housing 86 is preferably a pin 236 passing through an opening 238 in both sides 240, 242 of the shoe housing as well as an opening 244 proximate the second end 228 of the fixed pulley assembly carrier member 220. The rigid nature of the material of the first and second sidewalls 41, 42 of the U-shaped channel 36 prevents movement of the pin 236 and restrains the carrier member 220 in position.

As previously detailed, the first end 208 of the pulley cord 210 is secured to the second end 206 of the carrier member 186. The pulley cord 210 then traverses to the fixed pulley assembly 212 and reverses direction after passing around the second pulley 216. The cord then traverses back to the second pulley 190 of the translatable pulley assembly 184. After passing around the second pulley 190, the cord traverses to the first pulley 214 of the fixed pulley assembly 212. After wrapping one-half of the circumference of the first pulley 214, the cord reverses direction again and traverses within the U-shaped channel member 36 returning to the translatable pulley assembly 184 and wraps around one-half of the circumference of the first pulley 188.

After partially wrapping the first pulley 188 the cord traverses again within the U-shaped channel member 36 in the direction of the fixed pulley assembly 212. The pulley cord 210 traverses beneath the roller 230 and exits at the rear face 74 (See FIG. 6A) of the shoe 54. The second end 246 of the pulley cord 210 is secured to a hook 248 that in operation is secured to openings in the jambliner 20. The presence of the hook 248 prevents the cord from being withdrawn into the cutout portion of the shoe pursuant to the force applied by the spring 170. A faceplate 249, or similar type hardware, prevents retraction of the hook 248 due to the hook 248 being too large to pass through the faceplate 249. The pulley cord 210 is; however, capable of passing through the faceplate.

Figure 13A:
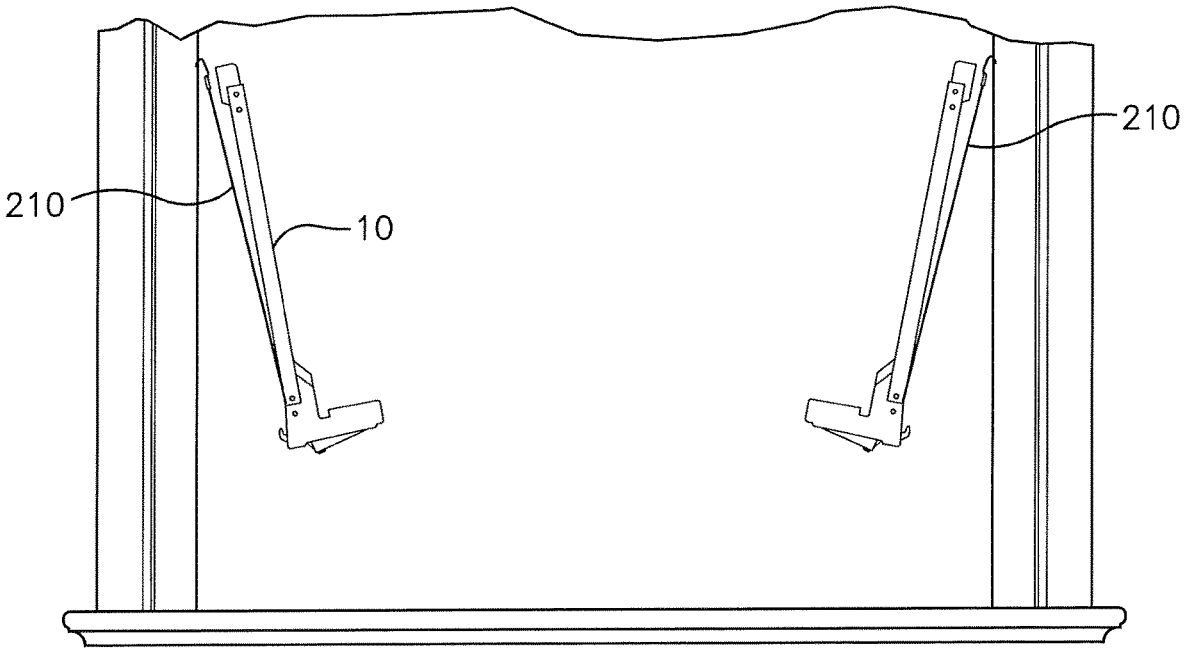
FIG. 13A is a front view of a window frame with embodiments of the two sash balances in initial engagement with the window jamb.
Figure 13B:
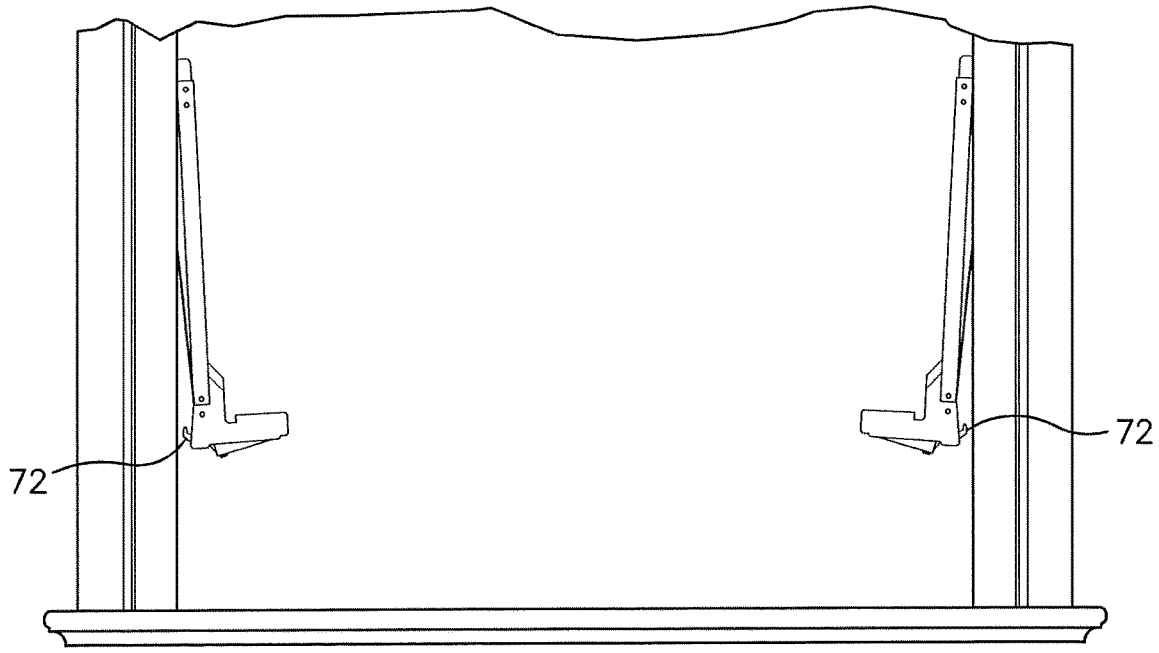
FIG. 13B is front view of a window frame with embodiments of the two sash balances ready for engagement of the locking features into the window jamb.
Figure 13C:
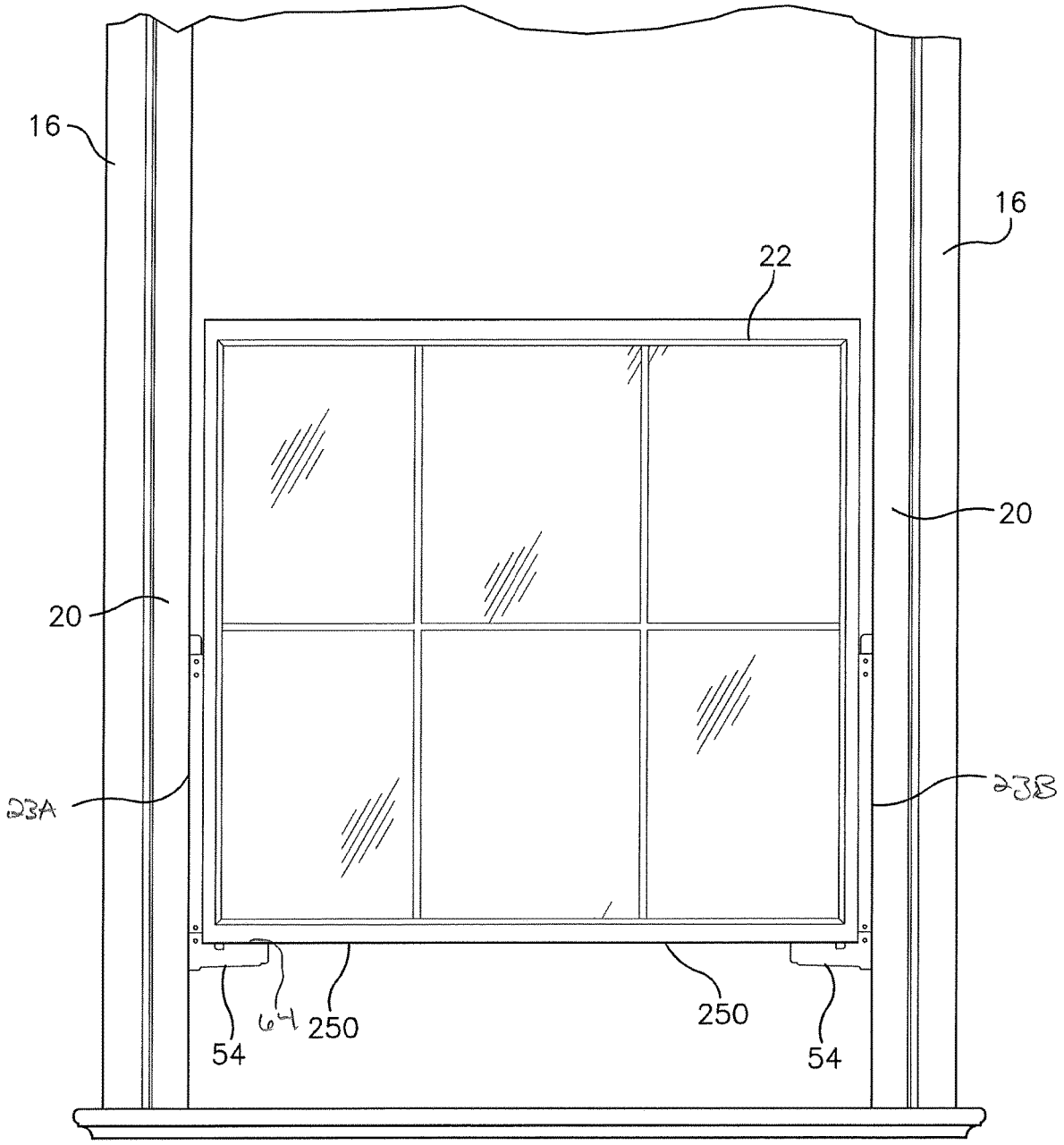
FIG. 13C is a front view of a window frame with embodiments of the two sash balances supporting a window sash.

In operation, as seen in FIGS. 13A-13C, a pair of sash balances 10 are sequentially installed in the jambs 16 of a window frame 12. These sash balances 10, as seen in FIG. 13C are used to support the underside 250 of a sash 22 positioned between the jambs 16 in a window frame 12. The installation and removal procedure is the same for both the left and right sash balances so a generic discussion of the process is set forth below. When installing the sash balance 10 onto the jambliner 20 the upwardly facing hook 72 of the locking feature 70 must be in the outwardly extended position. To place the upwardly facing hook into the outwardly extended position, the user applies manual pressure to the outermost nub 106 as best seen in FIGS. 6A and 6B.

This manually applied pressure causes one end 102 of the activator bar 88 to rotate upward within the lower portion 62 of the shoe 54 and the second end 100 to rotate downward. As the activator bar 88 rotates, the lever arm 134 connected to the activator bar 88 and the cylinder 138 connected at the distal end of the lever arm 134 rotate downward. As the cylinder 138 which resides transversely in the overhanging cutout 152 slides downward it engages with the saddles 154, 156 in the cutout causing the rocker arm 92 to rotate about the pin 142. Once the cylinder 138 presses against the saddles 154, 156, the rocker arm 92 begins to rotate about the restraining pin 142.

As the rocker arm 92 rotates, the upwardly facing hook 72 extends outwardly from the rear face 74 of the shoe 54 revealing the gap 80 between the backside 82 of the upward facing hook 72 and the rear face 84 of the shoe 54. The rocker arm 92 and activator bar 88 remain static in their new positions, i.e., with the hook extended, because of pressure applied by the compression spring 90 housed within the bore 112 of the activator bar 88. The compression spring 90 causes the lever arm 134 and cylinder 138 to apply pressure to the saddles 154, 156 in the cutout and to maintain the rocker arm 92 in the position with the upwardly facing hook 72 outwardly extended until the operator applies manual pressure to the first nub 104 overcoming the force applied by the compression spring 90.

With the retractable hook 72 extended, the user approaches the window frame 12 and engages the hook 248 at the second end 246 of the pulley cord 210 into an opening 254 in the top of the jambliner 20. The user then positions the sash balance guide 52 into the track 21 of the jambliner 20. The sash balance guide 52, as seen in FIGS. 2A and 2B, facilitates the movement of the sash balance in the jambliner 20 and slightly offsets the first end 38 of the U-shaped channel member 36 from the floor of the jambliner track 21. The slight offset distance D minimizes the area of surface contact between the U-shaped channel member 36 and the jambliner 20 thereby reducing the friction between the two surfaces. The sash balance guide 52 is preferably fabricated from an engineered plastic; however, alternative materials such as metal and ceramics would also be functional.

The user then applies manual downward pressure causing the pulley cord 210 to be withdrawn from the sash balance 10. The pulley cord 210 which terminates at the hook 248 and begins at the carrier member for the translatable pulley 186 is essentially inelastic such that when the hook 248 is extracted an immediate reaction occurs at the translatable pulley 186. The pulley configuration disclosed herein is a double tackle.

In a double tackle configuration, a single continuous cord 210 is used to transmit a tension force around the four pulleys, i.e., 188, 190, 214, 216 to move a load, in this case the load developed by the tension spring 170. The mechanical advantage of the block and tackle in the configuration disclosed herein is four (4), thus the block and tackle reduces the force required to extend the tension spring 170 by a factor of four (4). At the same time, the velocity ratio of the tackle is 4:1. In other words, to extend the tension spring 170 at a rate of 1 inch/second, the hook 248 must be retracted at a rate of 4 inches/second; however, the force necessary to extract the hook is only 25% of the load being applied to the carrier member 186 of the translatable pulley assembly 184.

As the user retracts the hook 248 from the sash balance 10, the double block and tackle system is engaged and the force necessary to extend the tension spring 170 is effectively only one-fourth of the load being applied by the spring itself. As the hook 248 is withdrawn and the sash balance is lowered into position the upwardly facing hook 72 is positioned within an opening 256 in the window jambliner 20. Once both sash balances 10 are installed into the jambs 16 of the window frame 12 the sash 22 may be installed within the window frame and ultimately atop the platforms 64. To install the sash 22, the sash is slightly rotated about a midline vertical axis and positioned superjacent the first sash balance platform 64. The first sash stile 23A is then pressed firmly into the jamb 16. The sash 22 is then rotated the opposite direction from the original rotation about the midline vertical axis and the second sash stile 23B is positioned within the opposing jamb 16 and superjacent the second sash balance platform 64. Next, the sash 22 is lowered into position atop the two shoe platforms 64.

Once the sash 22 is supported by the two sash balance platforms 64 the user slightly drops the sash 22 and presses the outermost nub 104 which causes the activator bar 82 to rotate upward driving the lever arm 134 and cylinder upward in the overhanging cutout 152 until the cylinder reaches the seats 164, 166 at the top of the cutout 152. Once the seats 164, 166 are impacted, the force applied to the seats causes the rocker arm 92 to rotate about the pin 142 and to retract the upwardly facing hook 70.

Once the two hooks 70 are retracted, the sash 22 is free to translate within the jambliner 20 and may be slid freely up and down with much of the weight of the sash being counterbalanced by the spring force of the sash balance 10. With much of the weight of the sash being counteracted by the sash balance spring force the level of effort required by the user to reposition the sash is reduced and sash movement requires less effort on the part of the user.

To remove the sash 22 using the system disclosed herein, the user lowers the hook 72 to below the opening 256 in the window jambliner. Once the hook 72 is below the opening 256, the user presses the inner most nub 106 on each shoe 54 and then proceeds to raise the sash balance and sash combination. Upon achieving the same elevation as the opening 256, the hook 72 will engage with the opening 256 and upward movement of the sash balance 10 will be halted. Once the sash balances 10 are locked into position the user applies a manual force to the sash 22 causing it to move laterally to one side. Once the sash 22 is displaced to one side the sash is rotated about the sash stile 23A or 23B on that same side and the sash stile on the opposite side may then be extracted from the frame 12. Once the first sash stile 23B is rotated out of the window frame the second sash stile 23A can readily be extracted.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

I claim:

1. A removable balance system for a sash movable vertically between a pair of window jambs with vertically extending jamb channels disposed within each of the jambs, said system comprising:

a. a U-shaped balance channel member with a first end and a second oppositely disposed end;

b. a shoe for supporting a lower corner of a sash, the shoe secured to the second end of the U-shaped balance channel, the shoe further comprising an upper portion secured to the U-shaped channel and a lower portion extending perpendicular to the U-shaped balance channel;

c. a locking feature selectively operable between extending laterally outwardly from the shoe for engagement with an opening in a first jamb channel and recessed within the shoe, the locking feature configured for securing the shoe against upward movement when installed within the first jamb channel;

d. a tension spring disposed within the U-shaped balance channel, the tension spring further comprising a first end and a second end, the first end secured in position proximate the first end of the U-shaped channel;

e. a translatable pulley assembly with a carrier member disposed within the U-shaped balance channel, wherein the carrier member is secured to the second end of the tension spring;

f. a fixed pulley assembly with a carrier member disposed within the U-shaped channel proximate the upper portion of the shoe;

g. a roller disposed within a channel in the upper portion of the shoe; and h. a cord with a first end secured to the carrier member of the translatable pulley assembly opposite the connection to the tension spring, the cord further engaging the translatable pulley system and the fixed pulley system forming a double tackle configuration and partially encircling the roller before exiting from the shoe terminating at and secured to a hook member; wherein in operation the hook member is inserted into an upper most opening in the first jamb channel and the cord is withdrawn to an extent sufficient for the locking feature to engage a second opening in the first jamb channel thereby securing the balance system in place within the first jamb channel providing a seat for the sash atop the shoe.

2. The removable balance system of claim 1, wherein a jamb guide is secured to the first end of the U-shaped channel.

3. The removable balance system of claim 1, wherein the lower portion of the shoe includes spaced apart first and second walls and an open space between the first and second walls.

4. The removable balance system of claim 3, wherein an activator bar is disposed within the open space between the first and second lower portion walls.

5. The removable balance system of claim 4, wherein the activator bar has first and second longitudinally disposed ends.

6. The removable balance system of claim 5, wherein a first and a second longitudinally separated detent nub are disposed on a lower surface of the activator bar.

7. The removable balance system of claim 6, wherein the activator bar further comprises a slot extending laterally across the activator bar proximate the second end of the activator bar.

8. The removable balance system of claim 7, wherein the activator bar further comprises a longitudinally extending bore, the bore terminating at a back wall proximate the first end of the activator bar.

9. The removable balance system of claim 8, wherein a compression spring with a first end and a second end is disposed within the longitudinally extending bore, the first end of the compression spring disposed against the bore back wall.

10. The removable balance system of claim 9, wherein a restraining pin extends outwardly from the first lower portion wall, through the activator bar slot thereby restraining the second end of the compression spring and finally into the second lower portion wall, the restraining pin maintaining the compression spring in a compressed state in the longitudinally extending bore of the activator bar.

11. The removable balance system of claim 10, wherein a lever arm extends upwardly and away from the first end of the activator bar terminating at a distal end.

12. The removable balance system of claim 11, wherein a cylinder is transversely mounted to the distal end of the lever arm.

13. The removable balance system of claim 12, wherein, in addition to the activator bar disposed within the lower portion, a rocker arm is disposed within the open space between the first and second walls of the lower portion and extends partially into the upper portion of the shoe.

14. The removable balance system of claim 13, wherein the rocker arm is rotatably secured in position by a pin passing through the walls of the upper portion and through a bore hole in the rocker arm.

15. The removable balance system of claim 14, wherein the rocker arm further comprises an overhanging cutout.

16. The removable balance system of claim 15, wherein the transverse cylinder of the lever arm slidably engages with the overhanging cutout.

17. The removable balance system of claim 16, wherein extending outwardly from the rocker arm is the locking feature.

18. The removable balance system of claim 17, wherein the activator bar and rocker arm are each operable between a first and second position.

19. The removable balance system of claim 18, wherein the first position of the activator bar and rocker arm retracts the locking feature.

20. The removable balance system of claim 19, wherein the second position of the activator bar and rocker arm extends the locking feature.

21. A balance apparatus for a sash movable vertically between a pair of window jambs with vertically extending slots disposed within each of the jambs, said system comprising:

a. a U-shaped channel member with a first end and a second oppositely disposed end;

b. a shoe for supporting a lower corner of a sash, the shoe secured to the second end of the U-shaped channel, the shoe further comprising an upper portion secured to the U-shaped channel and a lower portion extending perpendicular to the U-shaped channel;

c. a first hook member selectively operable between an outwardly extended orientation and a recessed orientation for engagement with and disengagement from a first opening in a first jamb slot, the first hook member configured for securing the shoe against undesired upward movement when installed within the jamb slot;

d. a tension spring disposed within the U-shaped channel, the tension spring further comprising a first end and a second end, the first end secured in position proximate the first end of the U-shaped channel;

e. a double tackle system disposed within the U-shaped channel wherein a first end of a rope is secured to the second end of the tension spring;

f. a roller disposed within a channel in the upper portion of the shoe; and g. a second end of the rope partially encircling the roller before terminating at a second hook member; wherein in operation the second hook member is inserted into a second opening in the first jamb slot and the rope is withdrawn to an extent sufficient for the first hook member to engage the first opening in the first jamb slot thereby securing the balance apparatus in position within the first jamb slot providing a seat for insertion of the sash atop the shoe; wherein downward displacement of the sash and shoe facilitates manual retraction of the first hook member into the recessed orientation permitting vertical movement of the sash within the first jamb slot.

* * * * *